US005430351A

United States Patent [19]

Yokota

[11] Patent Number: 5,430,351

[45] Date of Patent: Jul. 4, 1995

[54] CATHODE-RAY TUBE APPARATUS WITH MEANS FOR REDUCING LEAKAGE MAGNETIC FIELD

[75] Inventor: Masahiro Yokota, Kumagaya, Japan

[73] Assignee: Kabushiki Kaisha Toshiba, Kawasaki, Japan

[21] Appl. No.: 44,483

[22] Filed: Apr. 9, 1993

[30] Foreign Application Priority Data

Apr. 9, 1992 [JP] Japan ..... 4-088490

[51] Int. Cl.[6] ..... H01J 1/52

[52] U.S. Cl. ..... 313/440; 313/413

[58] Field of Search ..... 315/8; 335/211-215; 313/440, 413, 421, 426

[56] References Cited

U.S. PATENT DOCUMENTS

| | | | |
|---|---|---|---|
| 4,634,930 | 1/1987 | Toshiyasu et al. | 315/8 |
| 4,709,220 | 11/1987 | Sakane et al. | 335/214 |
| 4,734,620 | 3/1988 | Hemme | 315/8 |
| 4,853,588 | 8/1989 | Ohtsu et al. | 313/440 |
| 4,914,350 | 4/1990 | Bosch et al. | 315/8 |
| 4,975,618 | 12/1990 | Koba et al. | 313/521 |
| 5,107,179 | 4/1992 | Vidovich | 315/8 |
| 5,180,947 | 1/1993 | McGill | 315/8 |
| 5,229,689 | 7/1993 | Forsblad et al. | 315/8 |

FOREIGN PATENT DOCUMENTS

| | | |
|---|---|---|
| 0435602 | 7/1991 | European Pat. Off. . |
| 0523741 | 1/1993 | European Pat. Off. . |
| 62-64024 | 3/1987 | Japan . |
| 62-82555 | 5/1987 | Japan . |
| 3-16394 | 1/1991 | Japan . |
| 2223649 | 4/1990 | United Kingdom . |

OTHER PUBLICATIONS

"VLMF Compensating Coil", IBM Technical Disclosures Bulleting, vol. 31, No. 11, Apr. 1989, pp. 126-127.

*Primary Examiner*—Stephen Brinich

*Attorney, Agent, or Firm*—Cushman, Darby & Cushman

[57] ABSTRACT

A deflection yoke is attached to the outer periphery of a boundary portion between a cone portion and the neck of a funnel of a cathode-ray tube. The deflection yoke has a pair of saddle-shaped horizontal deflection coils. A pair of short-circuit loop, upper and lower, each having at least one turn, and a ring-shaped auxiliary core, formed of ferrite, are arranged in the vicinity of the deflection yoke. Portions of the short-circuit loops and a lead wire, which is connected to the horizontal deflection coils, extend individually through a hole in the auxiliary core. The auxiliary core, the lead wire, and the portions of the short-circuit loops constitute a magnetic circuit for interlinking a magnetic flux generated from the lead wire with the short-circuit loops.

5 Claims, 6 Drawing Sheets

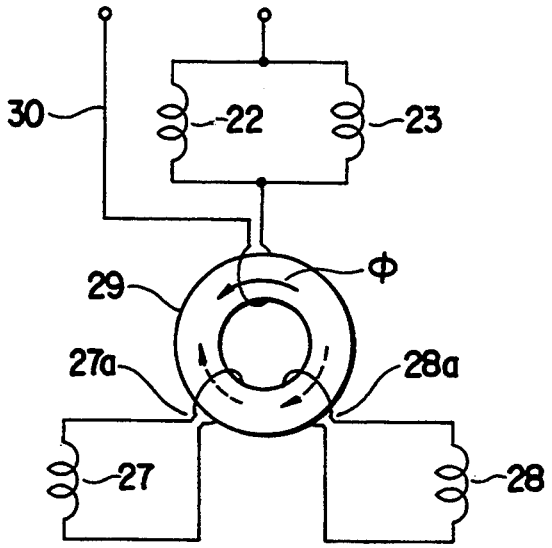
FIG. 5
FIG. 6A
FIG. 6B
FIG. 6C
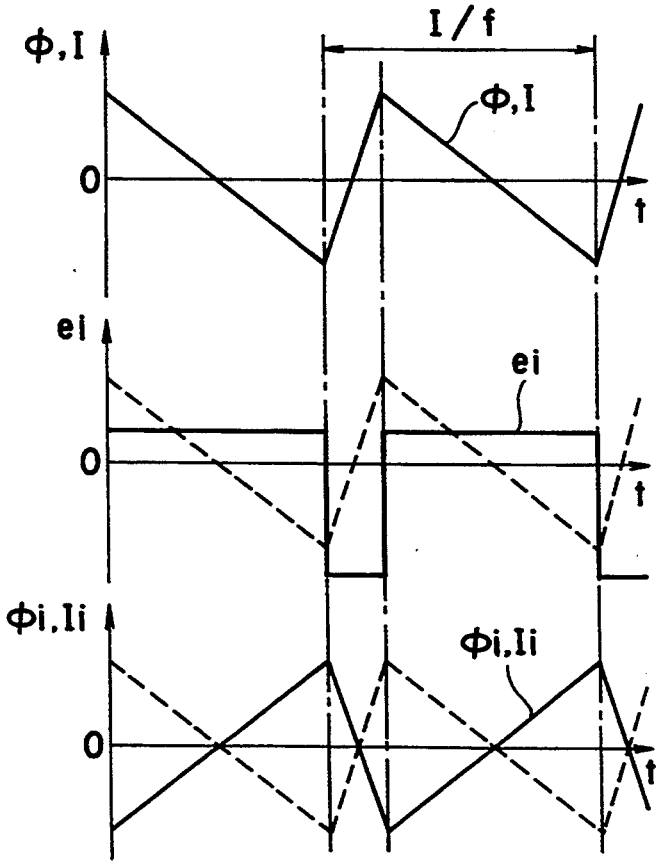

CATHODE-RAY TUBE APPARATUS WITH MEANS FOR REDUCING LEAKAGE MAGNETIC FIELD

BACKGROUND OF THE INVENTION

1. Field of the Invention

The present invention relates to a cathode-ray tube apparatus provided with short-circuit loops for reducing leakage magnetic fields generated from the apparatus, especially those leakage magnetic fields from a deflection yoke.

2. Description of the Related Art

Recently, influences of leakage magnetic fields leaking from the deflection yoke of cathode-ray tube apparatuses to its surroundings upon a person have been put in question, and there has been an increasing demand for the development of an improved cathode-ray tube apparatus in which the leakage magnetic fields can be reduced.

As a measure to suppress leakage magnetic fields around the cathode-ray tube apparatuses, there is a conventionally known method in which a metal plate is used to cover the whole deflection yoke. In this case, however, the metal plate cannot be located in front of the screen, so that the effect of leakage magnetic field reduction is inadequate, and it is difficult to reduce leakage magnetic fluxes to a desired level. Inevitably, moreover, the apparatus is large-sized.

In order to solve these problems for the case where the metal plate is used to restrain the leakage magnetic fields, a method using auxiliary coils is disclosed in U.S. Pat. No. 4,709,220 and Published Unexamined Japanese Patent Application No. 62-64024, for example. The auxiliary coil is formed having substantially the same shape as that of a saddle-shaped horizontal deflection main coil which constitutes a part of the deflection yoke, and is arranged outside the main coil so as to hold a core therebetween. Leakage magnetic fluxes from the horizontal deflection main coils are reduced by feeding part of electric current flowing through the main coils to the auxiliary coils, thereby causing the auxiliary coils to generate magnetic fluxes.

According to this method in which part of the horizontal deflecting current is supplied to the auxiliary coils, however, the load of the auxiliary coils causes a loss to the horizontal deflection sensitivity of the deflection yoke. Further, terminals or the like must be provided for connecting the auxiliary coils to a horizontal deflection system, so that the construction of the apparatus is inevitably complicated. The auxiliary coils are connected electrically to the deflection system including the horizontal deflection main coils. In case of a conduction failure in the auxiliary coil circuit system, therefore, image display will be hindered. Thus, the reliability and safety of the cathode-ray tube apparatus are lowered.

As a measure to solve the problems of the method using the auxiliary coils of the current supply type, a method using short-circuit loops which are not connected electrically to the deflection system is described in Published Unexamined Japanese Utility Model Application No. 62-82555, for example. According to this method, although leakage magnetic fields in the vicinity of transitive portions of the main deflection coils can be reduced, leakage magnetic fields in front of the screen cannot.

Described in Published Unexamined Japanese Patent Application No. 3-16394, moreover, is a method in which leakage magnetic fields are reduced using short-circuit loops of an electrical conductor, which include no additional circuit or element. These short-circuit loops are arranged in an interlinked region between where a magnetic flux in the direction opposite to deflected main magnetic fluxes ranging from the front transitive portions of the main deflection coils to the screen. In this case, however, the short-circuit loops should be located in the region through which the magnetic flux passes opposite to the deflected main magnetic fluxes, and parts of the loops must be located close to the transitive portions of the main deflection coils. Thus, the location of the short-circuit loops can enjoy no freedom, so that their mounting efficiency is low, and image deterioration may be caused by a change of the landing position of an electron beam.

SUMMARY OF THE INVENTION

The present invention has been contrived in consideration of these circumstances. An object of the present invention is to provide a cathode-ray tube apparatus in which leakage magnetic fields, generated from main deflection coils of a deflection yoke and leaking to the outside of the apparatus, can be effectively reduced without arousing any problems. Problems that are avoided include increased apparatus size, complicated construction, deflection sensitivity loss, decline in reliability, low operating efficiency, image deterioration, etc.

In order to achieve the above object, a cathode-ray tube apparatus according to the present invention comprises a cathode-ray tube including emitting means for emitting an electron beam, and a deflection yoke including a deflection coil system which has main deflection coils for deflecting the emitted electron beam for scanning and through which a deflecting current flows. Arranged in the vicinity of the deflection yoke are a short-circuit loop. The short-circuit loop is formed of an electrical conductor and generates a magnetic field for compensating a leakage magnetic field from the main deflection coils. The core is substantially formed of a magnetic material. A magnetic circuit is constituted by the core, the deflection coil system and the short-circuit loop. The magnetic circuit is for interlinking a magnetic flux generated from a part of the deflection coil system with the short-circuit loop.

Normally, the deflection yoke deflects the electron beam for scanning by subjecting the intensity of a magnetic field generated from the main deflection coils to time-based sawtooth fluctuations. Accordingly, a sawtooth fluctuating current flows through the deflection coil system.

Since the magnetic circuit is formed by parts of the deflection coil system, the short-circuit loop, and the core, a pulsating induced electromotive force is generated in the aforesaid part of the short-circuit loop. It is formed by the fluctuating current flowing through the part of the deflection coil system. An induced current is caused to flow through the whole short-circuit loop by the induced electromotive force. Influenced by a transient phenomenon, this induced current undergoes time-based sawtooth fluctuations. More specifically, a sawtooth induced current flows through the short-circuit loop, which then generates a magnetic field corresponding to this induced current. The leakage magnetic field of the cathode-ray tube apparatus can be compensated by aligning the direction of the magnetic field from the short-circuit loop with the compensating direction for the leakage magnetic field.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 8 show a cathode-ray tube apparatus according to an embodiment of the present invention, in which:

FIG. 1 is a longitudinal sectional view of the cathode-ray tube apparatus,

FIG. 2 is a perspective view of the apparatus taken from the rear side,

FIG. 3 is a perspective view showing a deflection yoke,

FIG. 4 is an enlarged perspective view showing an auxiliary core and holders, FIG. 5 is a diagram showing magnetic connections between short-circuit loops, horizontal deflection coils, and the auxiliary core, FIG. 6A is a graph illustrating time-based fluctuations of the magnetic field intensity of a deflection coil system, FIG. 6B is a graph illustrating time-based fluctuations of the induced electromotive force generated in the short-circuit loops, FIG. 6C is a graph illustrating time-based fluctuations of currents flowing through the short-circuit loops, FIG. 7 is a diagram showing distributions of leakage magnetic fields and compensation magnetic fields, and FIG. 8 is a diagram showing on-axis magnetic fields generated from the short-circuit loops;

DETAILED DESCRIPTION OF THE PREFERRED EMBODIMENTS

A cathode-ray tube apparatus according to an embodiment of the present invention will now be described in detail with reference to the accompanying drawings.

Figure 1:
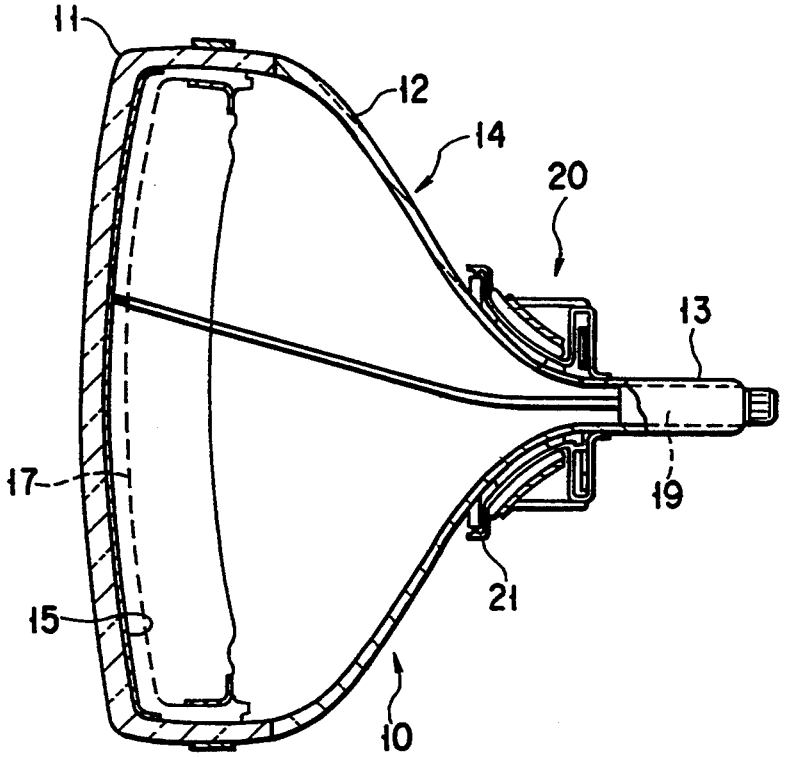
Figure 2:
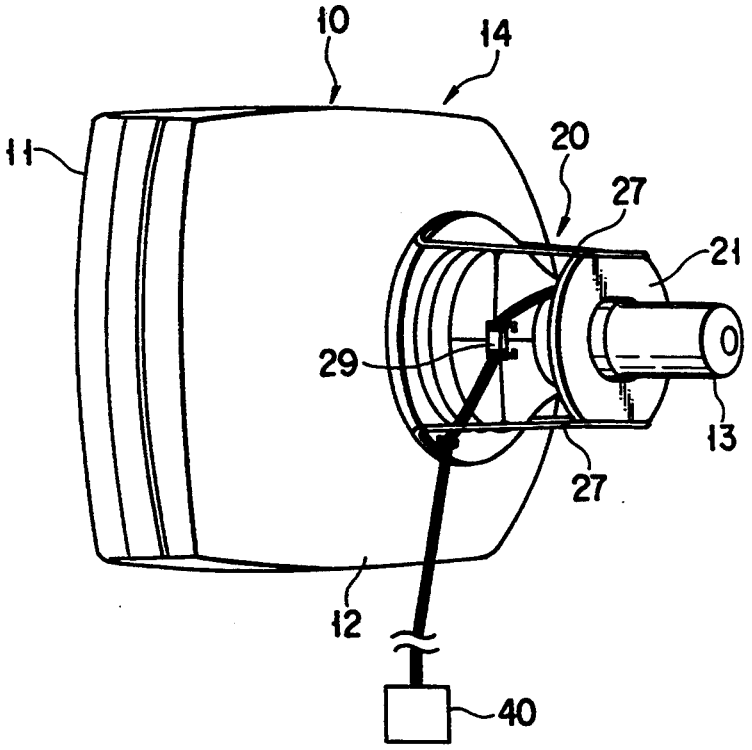

As shown in FIGS. 1 and 2, the cathode-ray tube apparatus comprises a cathode-ray tube 10, which is provided with an envelope 14 including a substantially rectangular front panel 11 and a funnel 12, bonded integrally to each other. A phosphor screen 15 is formed on the inner surface of the panel 11, and a shadow mask 17 is located facing the screen in the envelope. Also, an electron gun 19 for emitting electron beams toward the screen 15 is disposed in a neck 13 of the funnel 12.

Figure 3:
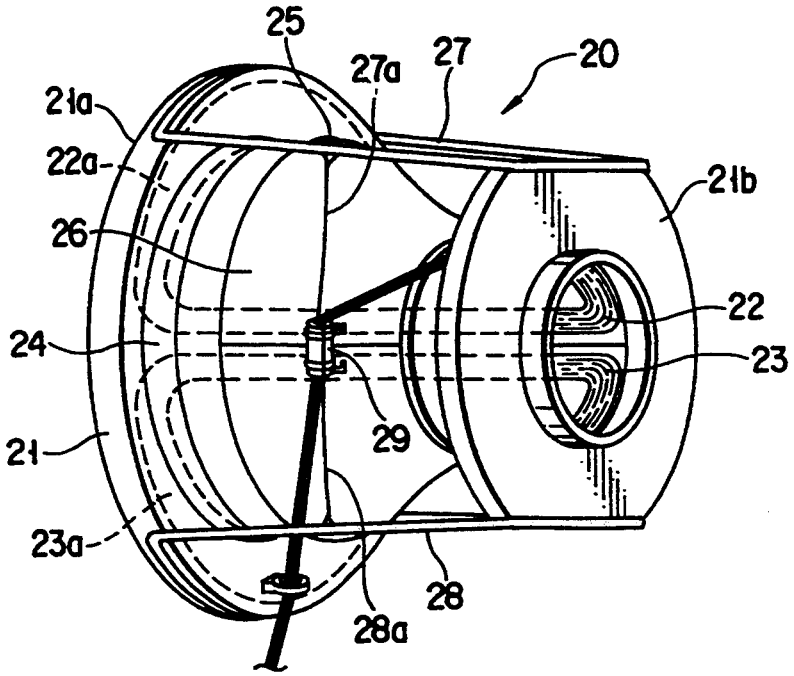

As shown in FIGS. 1 to 3, a deflection yoke 20 for deflecting the electron beams from the electron gun 19 is attached to the outer circumference of a boundary portion between a cone portion and the neck 13 of the funnel 12. The deflection yoke 20 includes a molded member 21 for use as a supporting member, substantially in the form of a truncated cone, and a pair of saddle-shaped horizontal deflection coils 22 and 23 and a pair of saddle-shaped vertical deflection coils 24 and 25, for use as main deflection coils for horizontal and vertical deflection, respectively, attached to the molded member 21.

The horizontal deflection coils 22 and 23, which are arranged inside the molded member 21 so as to be vertically symmetrical with respect to a horizontal plane containing the axis of the molded member, generate magnetic fields for horizontally deflecting the electron beams. The vertical deflection coils 24 and 25, which are arranged outside the molded member 21 so as be horizontally symmetrical with respect to a vertical plane containing the axis of the molded member, generate magnetic fields for vertically deflecting the electron beams. The coils 24 and 25 are covered by a magnetic yoke core 26 formed in a shape of a substantially truncated cone. The core 26 has a pair of saddle-shaped parts which are coupled with each other by means of clips 31 (described latter).

A pair of short-circuit loops 27 and 28, upper and lower, each having at least one turn, are arranged in the vicinity of the deflection yoke 20, that is, between front and rear flanges **21*a* and 21*b* of the molded member 21. More specifically, each of the short-circuit loops 27 and 28 is formed of an electrical conductor, e.g., a litz wire consisting of 20 to 200 $\phi$0.1 strands. The loops 27 and 28 are arranged vertically symmetrically with respect to a horizontal plane which contains the axis of the molded member 21. The respective screen-side end portions of the loops 27 and 28 are fixed to the outer peripheral surface of the front flange 21*a* of the molded member 21 and arranged outside those front transitive portions 22*a* and 23*a* of the horizontal deflection coils 22 and 23 which are situated on the screen side of the deflection yoke 20 with respect to the magnetic yoke core 26. Further, the respective electron-gun-side end portions of the loops 27 and 28 are fixed to the outer surface of the rear flange 21*b* of the molded member 21**.

Figure 4:
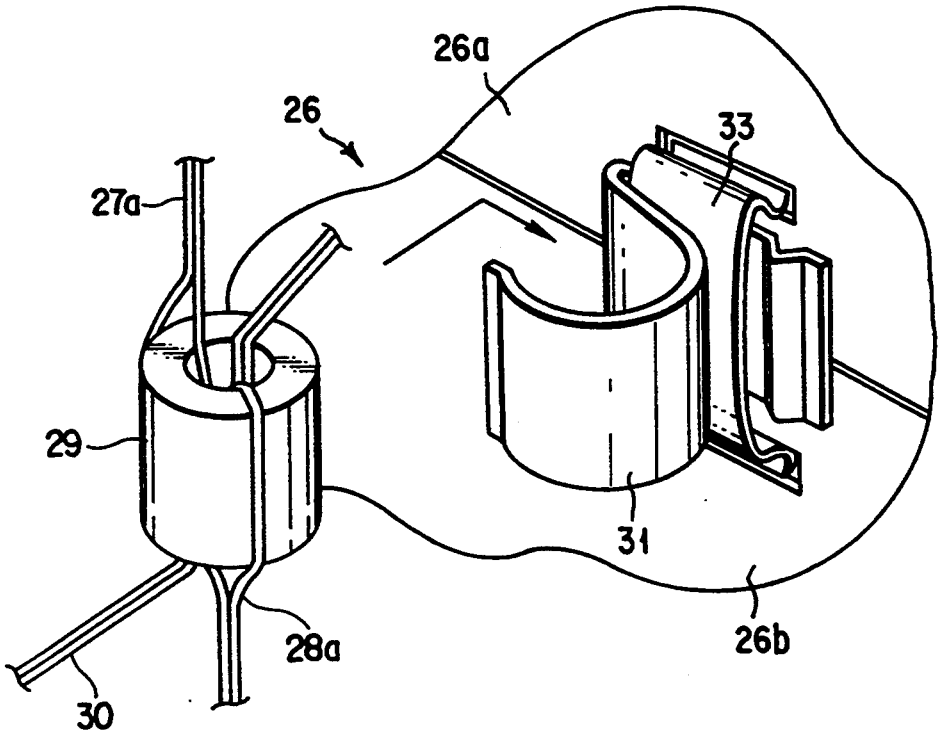

As shown in FIGS. 3 and 4, an auxiliary core 29, having a shape of a ring shaped bead and formed of ferrite as a magnetic material, is mounted on the outer surface of the magnetic yoke core 26 and situated between the flanges **21*a* and 21*b* of the molded member 21. This auxiliary core serves as a core in the present invention. A holder 31 is fixed to the outer surfaces of the magnetic yoke core 26 while being clamped between the core 26 and one of the clamps 33 for coupling the parts 26*a* and 26*b* of the core 26 with each other. The auxiliary core 29 is fitted and held in the holder 31**.

A lead wire 30, which is connected to the horizontal deflection coils 22 and 23, extends through the hole in the auxiliary core 29 to a deflecting current source 40 (see FIG. 2). The horizontal deflection coils 22 and 23 and the lead wire 30 constitute a deflection coil system through which a deflecting current flows. Wires **27*a* and 28*a*, which constitute parts of the upper and lower short-circuit loops 27 and 28, respectively, extend individually through the hole of the auxiliary core 29. Thus, the auxiliary core 29, the lead wire 30 passing through the core hole, and the wires 27***a* and 28*a* of the loops 27 and 28 constitute a magnetic circuit, as shown in FIG. 5.

Figure 7:
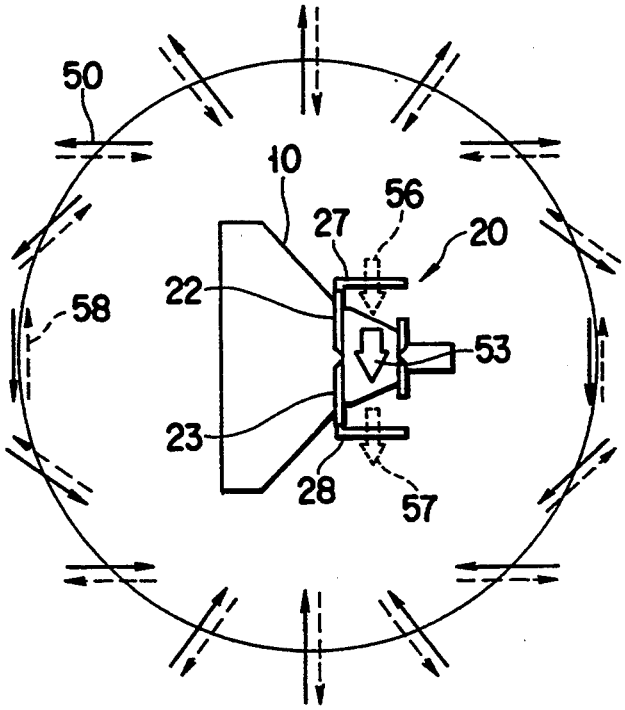

Referring now to FIGS. 5 to 7, the operation of the cathode-ray tube apparatus, constructed in this manner, will be described. FIG. 5 is a diagram showing magnetic connections between the horizontal deflection coils 22 and 23, the short-circuit loops 27 and 28, and the auxiliary core 29. FIGS. 6A, 6B and 6C are diagrams illustrating induced currents produced in the short-circuit loops. FIG. 7 is a diagram showing the relationships between leakage magnetic fields and compensation magnetic fields.

Normally, the electron beams emitted from the electron gun 19 are deflected for scanning by subjecting a magnetic field intensity Φ, which acts on the electron beams, to time-based sawtooth fluctuations at a deflecting frequency f, as shown in FIG. 6A. In the case, the magnetic circuit is formed including the wires 27*a* and 28*a* which constitute parts of the short-circuit loops 27 and 28 the lead wire 30 which constitutes part of the deflection coil system, and the auxiliary core 29, as mentioned before. A magnetic flux which is generated as the deflecting current and flows through the lead wire, passes through the interior of the auxiliary core 29, and is interlinked with the wires 27*a* and 28*a*, as shown in FIG. 5. The path of the magnetic flux is therefore a closed magnetic path. Thus, an induced electromotive force is generated in the wires 27*a* and 28*a* of the short-circuit loops by electromagnetic induction. Since the interlinked magnetic flux Φ is the time-based sawtooth fluctuations shown in FIG. 6A, the induced electromotive force ei fluctuates pulsatively, as shown in FIG. 6B. As the pulsating induced electromotive force ei is generated in the wires 27*a* and 28*a*, an induced current Ii flows through the short-circuit loops 27 and 28. The induced current Ii is represented by a complicated exponential function, which includes the inductance L of the short-circuit loops 27 and 28, resistance R, stray capacity C, deflecting frequency f, retrace period, etc., based on a transient phenomenon. If the deflecting frequency f is a high frequency of several tens of kilohertz or more, the resistance R and the stray capacity C are negligible. Accordingly, the induced current Ii has a waveform obtained by simply integrating the pulsating induced electromotive force ei by time, that is, sawtooth waveform which is opposite in polarity to the interlinked magnetic flux Φ, as shown in FIG. 6C. Thus, in the case of the deflection yoke 20 having the deflecting frequency f of several tens of kilohertz or more, a magnetic flux Φi generated from the short-circuit loops 27 and 28 is opposite in polarity to the interlinked magnetic flux Φ. The loops 27 and 28 are arranged so that magnetic fields in directions to compensate leakage magnetic fields, which leak from the horizontal deflection coils 22 and 23 to the outside of the cathode-ray tube apparatus, can be generated by using the sawtooth induced current Ii.

Referring now to FIG. 7, the layout of the short-circuit loops 27 and 28 will be described. In FIG. 7, full-line vectors 50 represent leakage magnetic fields which leak from the horizontal deflection coils 22 and 23 to the outside of the cathode-ray tube apparatus when the electron beams are deflected to the left-hand end of the screen 15. If a deflected main magnetic flux 53 from the deflection coil 22 and 23 is directed downward, then downward magnetic fields leak from the cathode-ray tube apparatus to the front, rear, left, and right thereof. On the other hand, if the short-circuit loops 27 and 28 are arranged substantially horizontally so that main magnetic fluxes 56 and 57 from the short-circuit loops advance in the same direction as the deflected main magnetic flux 53, as shown in FIG. 7, those magnetic fields which leak from the loops 27 and 28 to the outside of the cathode-ray tube apparatus advance in the directions opposite to those of the leakage magnetic fields from the horizontal deflection coil 22 and 23, that is, in the directions to compensate the leakage magnetic fields from the coil 22 and 23, as indicated by broken-line vectors 58 in FIG. 7. Thus, it is to be desired that the short-circuit loops 27 and 28 should be arranged substantially horizontally and so as to generate the main magnetic fluxes 56 and 57 which advance in the same direction as the deflected main magnetic flux 53.

If the short-circuit loops 27 and 28 are located close to the deflection yoke 20, the magnetic fluxes leaking from the main deflection coils are interlinked with the short-circuit loops. These interlinked magnetic fluxes are of the directions to lower the compensation effect of the short-circuit loops 27 and 28. Therefore, the effect of the loops to reduce the leakage magnetic fields can be further improved by, for example, keeping the loops away from the transitive portions of the saddle-shaped horizontal and vertical deflection coils so that the interlinked magnetic fluxes are minimized.

In the present embodiment, moreover, the respective screen-side end portions of the short-circuit loops 27 and 28 extend along the front flange 21*a* of the molded member 21 of the deflection yoke 20 and located around the front transitive portions 22*a* and 23*a* of the horizontal deflection coils 22 and 23, which are situated closer to the screen 15 than the magnetic yoke core 26 of the yoke 20. Thus, image deteriorations attributable to the magnetic fields generated from the short-circuit loops 27 and 28 can be prevented.

Figure 8:
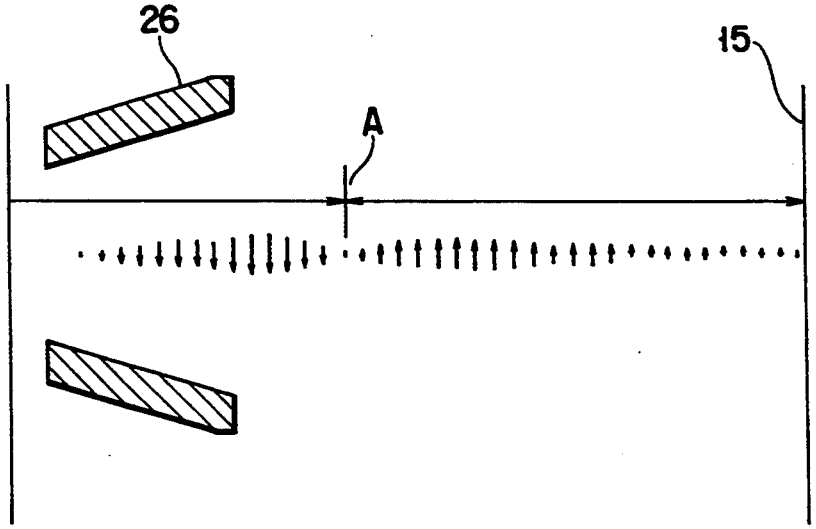

Change of the landing characteristic of the electron beams is an example of principal image deteriorations. It is attributable to longitudinal movement of the deflection center of the electron beams along the axis of the cathode-ray tube, which is caused by external addition of magnetic fields. FIG. 8 shows results of calculation of the intensity of the magnetic fields generated from the short-circuit loops 27 and 28, on the axis of the cathode-ray tube 10 of the cathode-ray tube apparatus according to the embodiment described above. Specifically, the arrows in FIG. 8 represent magnetic fields generated on the tube axis by the short-circuit loops 27 and 28 when the deflected main magnetic flux is directed downward. The magnetic fields generated from the short-circuit loops 27 and 28 are inverted in polarity at a certain point A on the tube axis so that they are in the same direction as the deflected main magnetic flux on the magnetic yoke core 26 side of the point A, and in the opposite direction on the screen 15 side. Thus, the total intensity of the magnetic fields for the entire deflection region is approximately zero. According to the cathode-ray tube apparatus constructed in this manner, therefore, the deflection center of the electron beams never moves, so that the landing characteristic of the electron beams undergoes no change. If the screen-side end portions of the short-circuit loops 27 and 28 shift toward the magnetic yoke core 26, the magnetic fields generated from the loops have their upward components intensified, so that the center of deflection shifts backward or toward the electron gun 19. If the screen-side end portions of the short-circuit loops 27 and 28 shift toward the screen 15, on the other hand, the center of deflection shifts forward or toward the screen. The shift of the center of deflection of the electron beams can be reduced to zero by locating the screen-side end portions of the short-circuit loops 27 and 28 near the outer periphery of the transitive portions 22*a* and 23*a* of the horizontal deflection coils 22 and 23.

Preferably, the distance between the screen-side end portion of each short-circuit loop and the magnetic yoke core 26 is adjusted to about 15 mm.

Further, the respective screen-side end portions of the short-circuit loops 27 and 28 extend along the circumferential direction of the front flange 21*a* of the molded member 21, and are situated within a plane perpendicular to the axis of the cathode-ray tube 10. Accordingly, the distribution of the magnetic fields from the short-circuit loops 27 and 28 is uniform with respect to the perpendicular plane, and change of the convergence characteristic of the electron beams can be also reduced to approximately zero.

In the apparatus of the present embodiment, the leakage magnetic fields are halved, increasing the deflection sensitivity loss only 1%, or can be reduced substantially completely, increasing the deflection sensitivity loss only 3%.

According to the cathode-ray tube apparatus constructed in this manner, the short-circuit loops formed of an electrical conductor are arranged in the vicinity of the deflection yoke, and parts of the short-circuit loops, part of the deflection coil system, and the auxiliary core constitute the magnetic circuit, as mentioned before. Accordingly, the compensation magnetic fields can be generated from the short-circuit loops in synchronism with the deflection of the electron beams by using the magnetic circuit, without directly electrically connecting the deflection coil system and the loops. Consequently, the leakage magnetic fields leaking from the main deflection coils to the outside of the cathode-ray tube apparatus can be reduced effectively. Since the components for tackling the leakage magnetic fields, that is, the short-circuit loops, auxiliary core, etc., are formed integrally with the deflection yoke, mounting them on the cathode-ray tube can be facilitated without lowering the reliability. Further, the deflection sensitivity loss can be reduced so that its influence upon the other characteristics of the cathode-ray tube can be lessened. In other words, the influence of the compensation magnetic fields upon the landing characteristic can be made smaller. Since the short-circuit loops for generating the compensation magnetic fields and the main deflection coils are provided separately, moreover, an effect for restraining a ringing of the short-circuit loops can be expected.

Although one magnetic ring for defining the closed magnetic path is used as the auxiliary core in the embodiment described above, a plurality of magnetic bodies may used instead to restrain the deflection sensitivity loss and intensify the compensation magnetic fields. Moreover, the wires of the respective parts of the deflection coil system and the short-circuit loops may be wound for a plurality of turns each around the auxiliary core.

In general, there are the following three methods for increasing the compensation effect for the leakage magnetic fields.

According to a first method, the electromotive force produced in the short-circuit loops is enhanced. This can be achieved by increasing the magnetic fluxes interlinked with the short-circuit loops. For example, electromotive force can be enhanced by increasing the sectional area of the auxiliary core or the number of turns of the part of the deflection coil system compared with the auxiliary core.

According to a second method, the induced currents in the short-circuit loops are increased. This can be achieved by lowering the impedance of the short-circuit loops. More specifically, in order to lower the inductance and resistance effectively, the short-circuit loops are simplified in construction or the number of turns of each loop is reduced, and a plurality of electric wires, such as litz wires, whose resistance increases little at high frequency are arranged as the loop wires in parallel.

According to a third method, the compensation magnetic fields are enlarged. This can be effectively achieved by, for example, increasing the area defined by each of the short-circuit loops or arranging a magnetic body in the loop so as to increase the magnetic permeability of the loop.

Preferably, the magnetic body which forms the auxiliary core should be of a material which enjoys a high saturated magnetic flux density, produces little heat, and is not substantially temperature-dependent. The permeability of the auxiliary core should be selected in accordance with the core shape, deflecting current value, etc. so that the effect of leakage magnetic field reduction and the deflection sensitivity loss are optimum.

In order to prevent an increase of the inductance, it is advisable to lessen the number of turns of that part of the deflection coil system which constitutes the magnetic circuit. The direction of the magnetic fluxes generated in the auxiliary core by the agency of the short-circuit loops is the direction in which the magnetic fluxes generated by the main deflection coils are compensated. Thus, the magnetic fluxes generated in the auxiliary core can be reduced substantially to restrain the production of heat in the auxiliary core by setting the turn ratios between the short-circuit loops and the main deflection coils and designing the short-circuit loops so that the magnetic fluxes can be compensated satisfactorily.

In the present embodiment, the short-circuit loops and the auxiliary core, which are designed for the reduction of the leakage magnetic fields, are fixed on the base or molded member of the deflection yoke so that they are entirely integral with the yoke. Therefore, this deflection yoke may be also used in any other cathode-ray tubes, as a deflection yoke which can tackle the leakage magnetic fields.

Figure 9:
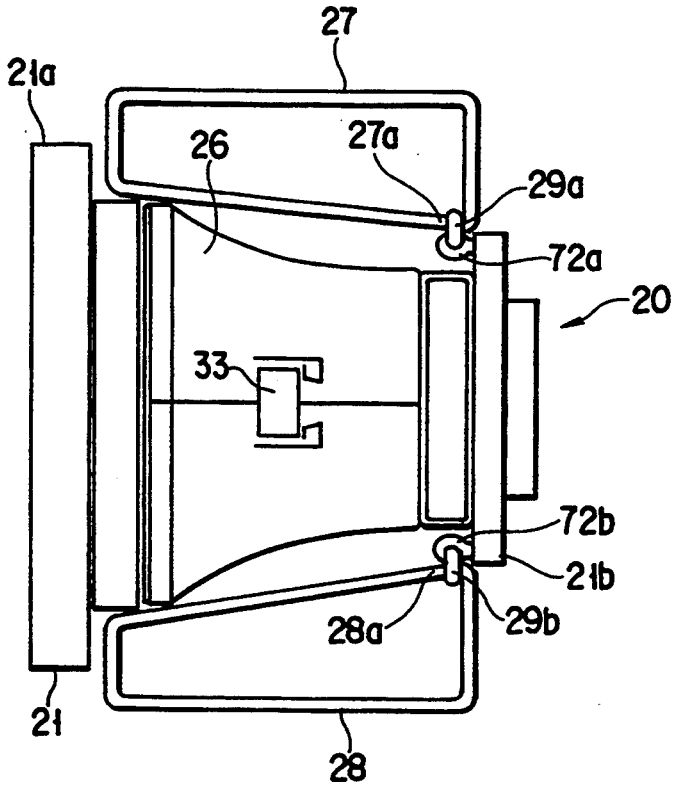
FIG. 9 is a plan view showing a deflection yoke of a cathode-ray tube apparatus according to another embodiment of the invention.

FIG. 9 shows another embodiment of the present invention. According to this embodiment, a pair of short-circuit loops 27 and 28 are arranged substantially horizontally on either side of a deflection yoke 20 in a manner such that magnetic fluxes generated from the loops are in the same direction as deflected main magnetic fluxes from main deflection coils. A part 27*a* of the short-circuit loop 27 and a part 72*a* of a deflection coil system are passed through the hole in a ring-shaped auxiliary core 29*a*, thus forming a magnetic circuit. Likewise, a part 28*a* of the short-circuit loop 28 and a part 72*b* of the deflection coil system are passed through the hole in a ring-shaped auxiliary core 29*b*, thus forming another magnetic circuit. Also in the second embodiment arranged in this manner, the same effect of the foregoing embodiment can be obtained.

Figure 10:
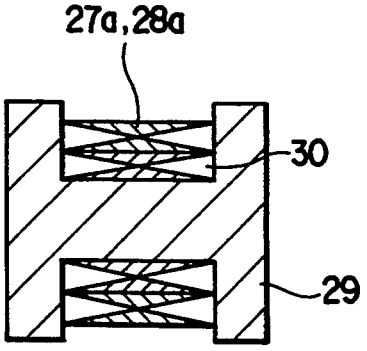
FIG. 10 is a sectional view showing a modification of the auxiliary core.

Although the auxiliary core which constitutes the magnetic circuit is in the form of a ring or closed magnetic path according to the embodiments described above, the present invention is not limited to this arrangement. More specifically, the auxiliary core 29 which constitutes the magnetic circuit is not limited to the ring-shaped configuration, and may be formed so as to define an open magnetic path, as shown in FIG. 10, for example. In this case, a part 30 of the deflection coil system and the parts 27*a* and 28*a* of the short-circuit loops are wound around the outer surface of the auxiliary core 29, thus forming a magnetic circuit.

Figure 11A:
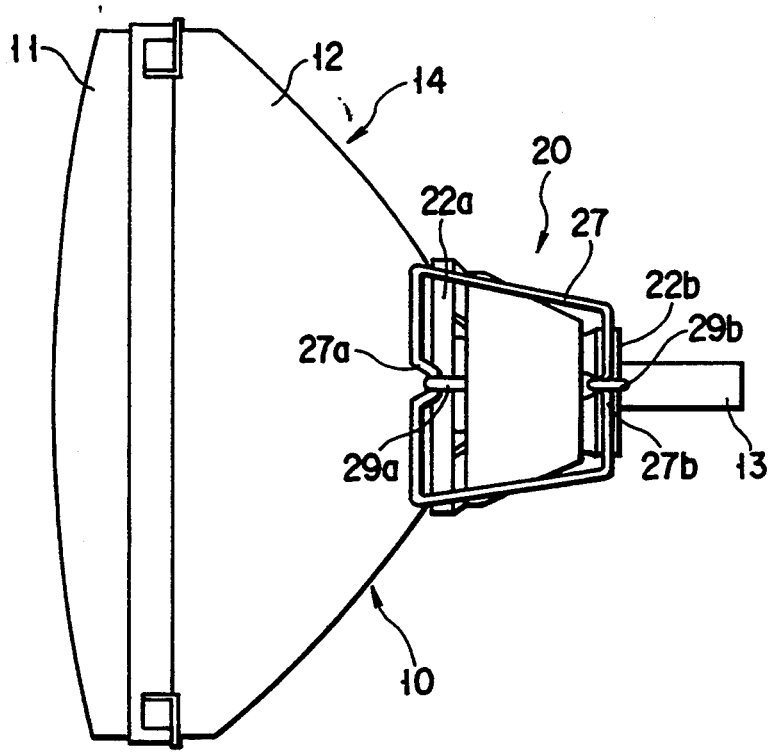
FIGS. 11A and 11B are a plan view and a side view, respectively, showing a cathode-ray tube apparatus according to still another embodiment of the invention.
Figure 11B:
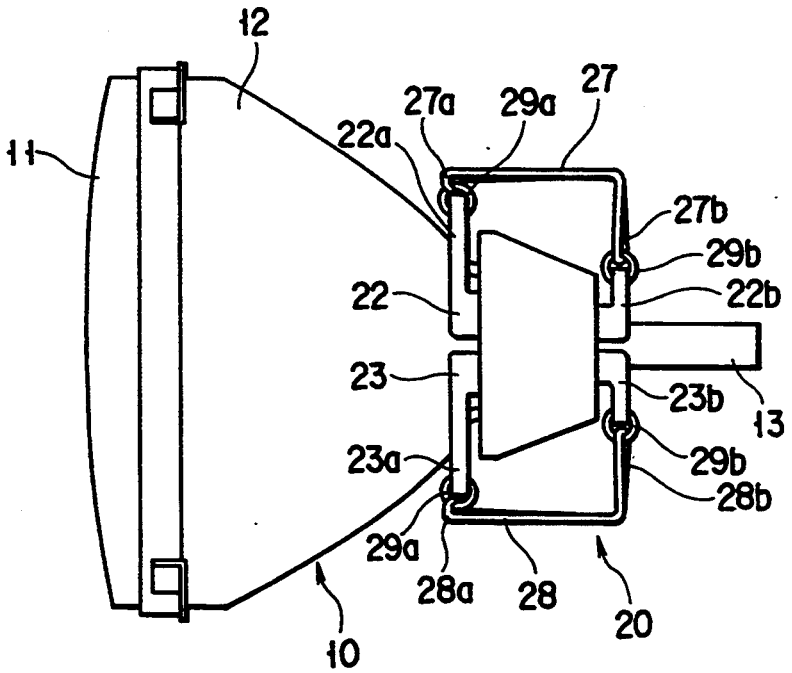

In the foregoing embodiments, moreover, the lead wires extending from the main deflection coils of the deflection coil system constitute a part of the magnetic circuit. Alternatively, however, the main deflection coils themselves, along with the auxiliary core, may be arranged so as to form the magnetic circuit. According to an embodiment shown in FIGS. 11A and 11B, for example, a part 27*a* of the screen-side end portion of an upper short-circuit loop 27 and a part of a front transitive portion 22*a* of a saddle-shaped horizontal deflection coil 22 are passed through the hole in a ring-shaped auxiliary core 29*a*, thus forming a magnetic circuit. Also, a part 27*b* of the electron-gun-side end portion of the loop 27 and a part of a rear transitive portion 22*b* of the deflection coil 22 are passed through the hole in a ring-shaped auxiliary core 29*b*, thus forming a magnetic circuit. Likewise, both end portions of a lower short-circuit loop 28, along with front and rear transitive portions 23*a* and 23*b* of a saddle-shaped horizontal deflection coil 23 and the pair of auxiliary cores 29*a* and 29*b*, form magnetic circuits, individually. Also in this arrangement, fluctuating currents can be fed to the short-circuit loops 27 and 28 through the magnetic circuits, so that leakage magnetic fields can be reduced.

It is to be understood that the present invention is not limited to the embodiments described above, and that various changes and modifications may be effected therein by one skilled in the art without departing from the scope or spirit of the invention. For example, it is necessary only that each magnetic circuit be formed of a part of the deflection coil system, a part of each short-circuit loop, and the auxiliary core, and the relative positions of these members may be varied as required. Although the saddle-shaped coils are used for both the horizontal and vertical deflection coils according the above-described embodiments, moreover, the coil shape is not limited to this configuration.

Further, the present invention may be applied to monochromatic cathode-ray tubes, as well as color cathode-ray tubes. Furthermore, each short-circuit loop must only be formed of an electrical conductor, and various other suitable materials than the litz wire may be used for the loop.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cathode-ray tube apparatus comprising:

a cathode-ray tube including emitting means for emitting an electron beam;

a deflection yoke including a deflection coil system which has main deflection coils for generating a magnetic field for deflecting the emitted electron beam for scanning and through which a deflecting current flows;

short-circuit loops for generating a magnetic field for compensating a leakage magnetic field from the main deflection coils, the loops being formed of an electrical conductor and arranged in the vicinity of the deflection yoke; and a core formed of a magnetic material, having a closed magnetic path, and constituting, along with the deflection coil system and the short-circuit loops, a magnetic circuit for interlinking a magnetic flux generated from a part of the deflection coil system with the short-circuit loops.

2. An apparatus according to claim 1, wherein said core is in the form of a ring having a hole through which said part of the deflection coil system and parts of the short-circuit loops are passed.

3. An apparatus according to claim 2, wherein said part of the deflection coil system includes a lead wire extending from the main deflection coils and passed through the hole of the core.

4. An apparatus according to claim 2, wherein each of said main deflection coils has a portion passed through the hole of the core.

5. A cathode-ray tube apparatus comprising:

a cathode-ray tube including emitting means for emitting an electron beam;

a deflection yoke including a deflection coil system which has main deflection coils for generating a magnetic field for deflecting the emitted electron beam for scanning and through which a deflecting current flows;

short-circuit loops for generating a magnetic field for compensating a leakage magnetic field from the main deflection coils, the loops being formed of an electrical conductor and arranged in the vicinity of the deflection yoke; and a core formed of a magnetic material, having an open magnetic path, and constituting, along wit the deflection coil system and the short-circuit loops, a magnetic circuit for interlinking a magnetic flux generated from a part of the deflection coil system with the short-circuit loops, said part of the deflection coil system and parts of the short-circuit loops being wound around the core.

* * * * *